United States Patent [19]

Krall

[11] Patent Number: 4,834,940

[45] Date of Patent: May 30, 1989

[54] METHOD FOR PRODUCING POWDERED METAL COMPACTS WITH FINE HOLES

[75] Inventor: Jack Krall, Latrobe, Pa.

[73] Assignee: Newcomer Products, Inc., Latrobe, Pa.

[21] Appl. No.: 227,354

[22] Filed: Aug. 3, 1988

[51] Int. Cl.[4] ..... B22F 3/14

[52] U.S. Cl. ..... 419/66; 419/2

[58] Field of Search ..... 419/66, 2

[56] References Cited

U.S. PATENT DOCUMENTS

| | | | |
|---|---|---|---|
| 3,996,048 | 12/1976 | Fiedler | 419/5 |
| 4,196,504 | 4/1980 | Eastman | 419/2 |
| 4,383,854 | 5/1983 | Dembowski et al. | 419/1 |
| 4,698,205 | 10/1987 | Oskarsson et al. | 419/5 |
| 4,726,927 | 2/1988 | Morgan et al. | 419/9 |

*Primary Examiner*—Stephen J. Lechert, Jr.

*Attorney, Agent, or Firm*—Buchanan Ingersoll; Michael Dever

[57] ABSTRACT

Tooling and a method are provided for producing powder metal compacts in which a fine hole is provided through the compact without the need for secondary operations. A top punch and bottom punch are used in an opposing relationship and a stem is provided on the top punch to form the hole through the compact. A resilient member is placed upon the bottom punch opposite the stem. When powder metal is introduced into the die cavity of the press, the powder is compressed by pressing the first punch against the second punch. During this powder compaction process, the stem of the first punch will press through the powder until it engages and penetrates the resilient member. When the first punch and second punch are released, a powder metal compact is formed having a hole provided the entire length therethrough. Such a powder metal compact is especially designed for use as a wire-drawing die.

7 Claims, 2 Drawing Sheets

12
14
15
16
17
18
20
22

METHOD FOR PRODUCING POWDERED METAL COMPACTS WITH FINE HOLES

BACKGROUND OF THE INVENTION

1. Field of the Invention

The present invention relates to a method and apparatus for producing powdered metal compacts. More particularly, the present invention relates to a method and apparatus for producing hard metal wire drawing dies, particularly compacts or wire drawing dies with fine holes.

2. Description of the Prior Art

In normal practice, metal compacts are produced by compacting powder metals such as tungsten carbide-cobalt mixtures in a press. Generally, two opposing punches are used to compact the powder metal mixture under pressure. Typically, the punches are designed such that they impart a unique geometry to the compacted powder metal. The compacted metal is then sintered to form the "hard metal" product.

One use for the metal compacts is as wire-drawing dies. Wires having diameters as fine as 0.004 or 0.005 inches can be formed using such a die. These dies are pressed by a punch which generates the very fine hole in the compact by use of a thin, elongated stem. In holes larger than 0.015 inches, the opposing punch is provided with a reciprocating hole. For fine holes (less than 0.015 inches), the opposing punch may be provided with a depression opposite the stem of the first punch. This leaves a bubble of compacted metal which covers the hole formed by the stem. By using such a method, the precision placement of the opposing punches is not as critical as when the stem must enter a reciprocating hole in the opposing punch, thereby reducing the risk of breakage of the fine stem of the first punch.

By providing this depression in the opposing punch, a secondary operation is needed to form the wire-drawing die. The bubble left by the depression must be ground off to expose the hole formed by the stem. In addition, some dies require a back tapered hole to relieve the stresses on the wire during the drawing operation. Such a back-taper requires an additional secondary operation to create the desired hole contour. Accordingly, there is a need for a one-step method for producing a compaction of powdered metal components having very small holes and an apparatus for accomplishing the same.

SUMMARY OF THE INVENTION

The present invention provides a one-step method and apparatus for producing a compaction of powdered metal components having a very small hole provided therein. A resilient member, such as a plastic or rubber sphere, is positioned upon the bottom punch before the powder metal is deposited into the die cavity for compaction. The stem of the punch penetrates the resilient member during the compaction process. Because the resilient member is relatively soft, the stem is protected from breakage as it penetrates the member. However, the resilient member should not be so soft as to deform during compaction or while being penetrated by the stem. The resilient member may be removed from the compact after ejection, or may be burned out during sintering, thereby exposing the exit end of the small hole.

The present method is especially suited for bottom punches having a depression provided therein. The resilient member is placed within the depression before the powder metal is deposited into the die cavity for compaction. This resilient member occupies the space which would otherwise have been previously filled with powder and acts as a receiver for the fine stem of the top punch which penetrates it during the compaction process. Removal of the resilient member after ejection exposes the exit end of the fine hole without the need for a secondary guiding or machining operation.

The present method and apparatus also eliminates the need to manually back-taper the hole. In the present method, the back-tapering of the hole is accomplished automatically by the shape of the resilient member which is pressed into the compact. Various shapes of the resilient members can be used to create different back-taper contours. By using the present method and apparatus, compacted tools of sorts which previously required intricate shapes machined into them after compaction can now be formed in a single operation.

DESCRIPTION OF THE PREFERRED EMBODIMENTS

Figures 1, 2, 3, 4, 5:
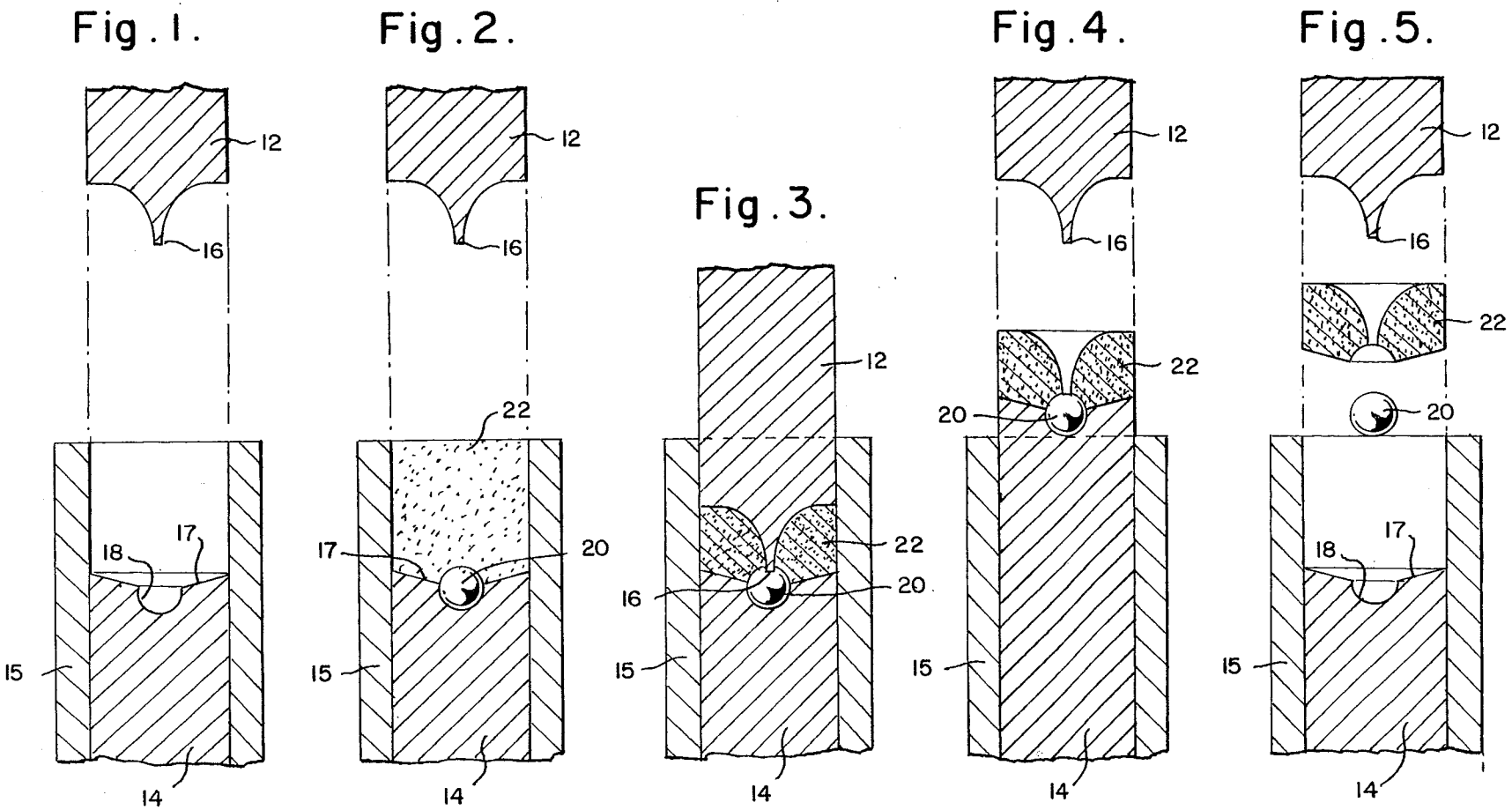
FIG. 1 is a front sectional view of a preferred embodiment of a press operated in accordance with the present invention.
FIG. 2 is a front sectional view of the press of FIG. 1 after the resilient member and powder metal have been added.
FIG. 3 is a front sectional view of the press of FIG. 1 during the compaction process.
FIG. 4 is a front sectional view of the press of FIG. 1 during the ejection process.
FIG. 5 is a front sectional view of the press of FIG. 1 showing an ejected die.

As shown in FIGS. 1 through 5, press 10 is used to compact powder metal and form a very fine hole in the compact. Press 10 is formed of a top punch 12, a bottom punch 14 and die walls 15. Stem 16 is provided in top punch 12 and is used to form the thin wire drawing diameter within the compacted powder metal. Preferably, stem 16 is generally cylindrical. However, stem 16 can be formed in any shape that can be easily fabricated. Preferably, depression 18 is provided in bottom punch 14 opposite stem 16.

As shown in FIG. 2, resilient member 20 is provided within depression 18 and is sized such that it extends beyond the top surface 17 of bottom punch 14. Typically, the depression 18 is hemispherical in shape and resilient member 20 is a sphere which is sized to fit within the depression 18. I have found that plastic, rubber, or nylon can be used to form the resilient member 20. However, any resilient compound that does not damage stem 16 can be used in accordance with the present invention. After resilient member 20 has been positioned, powder metal 22 is added to the die cavity.

As shown in FIG. 3, top punch 12 is pressed through the die cavity to compact the powder 22. Stem 16 contacts, and penetrates resilient member 20. Thus, when top punch 12 is released, as shown in FIGS. 4 and 5, a fine hole is provided through the powder metal compact 22 which can then be sent to the furnace for sintering. By providing resilient member 20 within depression 18, the secondary operation of grinding the compacted powder to expose the hole is no longer needed.

In addition to eliminating the secondary operation of grinding the compacted metal powder, resilient member 20 also determines the contour of the compacted powder metal 22. If a desired contour is needed for a particular wire-drawing operation, that contour can be formed by using an appropriately shaped resilient member 20. In this manner, an additional operation of grinding or machinining the back side of the wire drawing die is eliminated.

It is desirable to remove the resilient member 20 after ejection of powder metal compact 22 from the die cavity and separate it from powder metal compact 22. However, if resilient member 20 is formed from a material that will burn off during sintering and not damage the powder metal compact 22 physically or metallurgically, resilient member 20 need not be removed.

Figure 6:
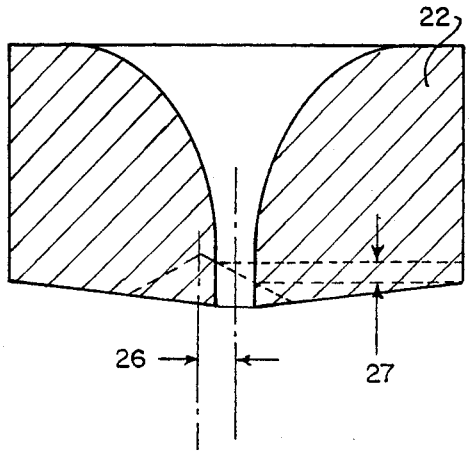
FIG. 6 is a front sectional view of a wire drawing die having an angled recess.
Figure 7:
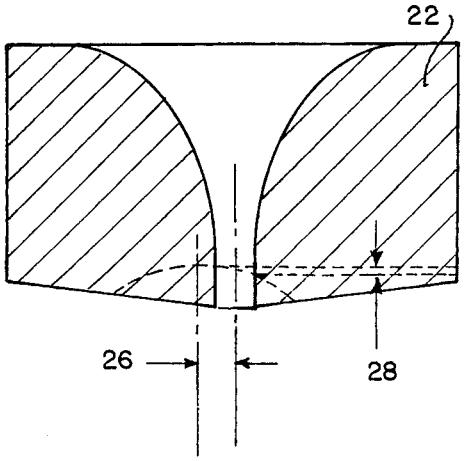
FIG. 7 is a front sectional view of a wire drawing die having a radius recess.

The radius back-taper produced by resilient member 20 in compacted powder metal 22 provides quality improvements to a compacted powder metal 22 formed in accordance with this method. As shown in FIG. 6, in order to form a back-taper, the prior art methods utilized a drill to produce an angle recess. This method required precision in the location of the drill. Because of the angle recess, a small drill locating error 26 produces a relatively large resultant side wall error 27. In contrast, as shown in FIG. 7, a small locating error 26 in the placement of resilient member 20 produces but a small resultant side wall error 28. This smaller resultant wall error provides tighter quality control and permits a larger percentage of usable product to be formed.

In order to promote the production speed for forming the wire-drawing dies, centering means, such as the inwardly-sloping top surface 17 of bottom punch 14 is provided. The inclined top surface 17 will position resilient member 20 within depression 18.

Figure 8:
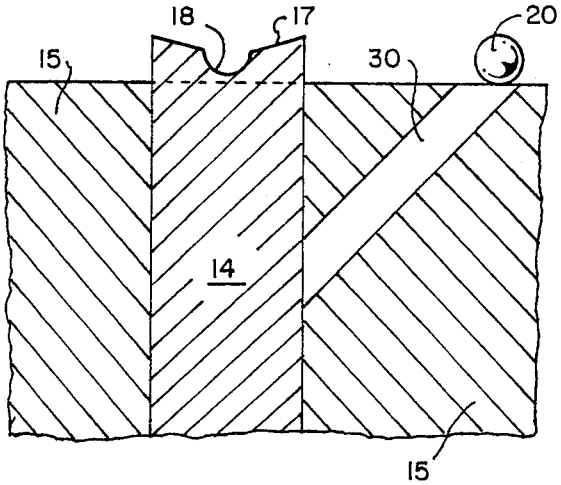
FIG. 8 is a front sectional view of a preferred embodiment of a ball feed mechanism in accordance with the present invention.
Figure 9:
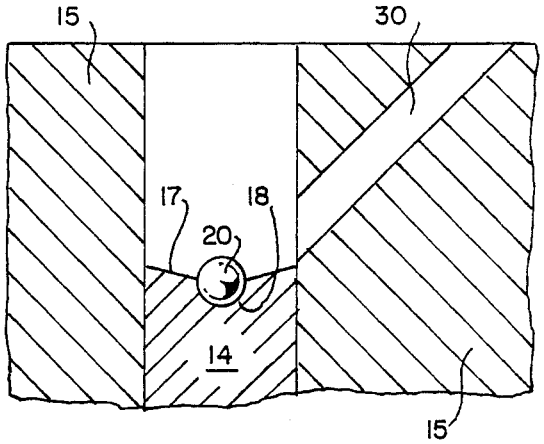
FIG. 9 is a front sectional view of the ball feed mechanism of FIG. 8 showing the resilient member entering the die cavity.
Figure 10:
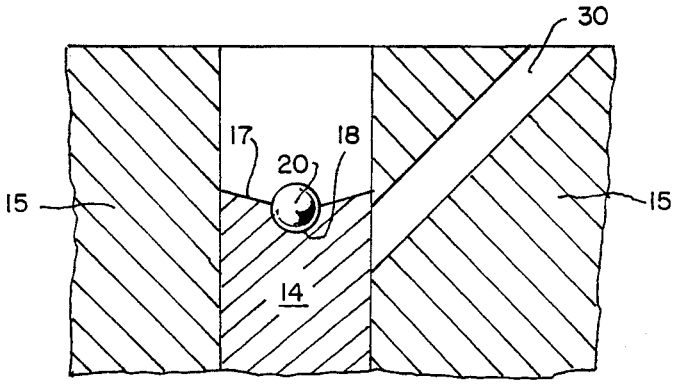
FIG. 10 is a front sectional view of the ball feed mechanism of FIG. 8 after the resilient member has entered the die cavity and the bottom punch has moved to the fill position where it is ready to receive the metal powder.

In order to speed production of the wire-drawing dies, an apparatus as shown in FIGS. 8–10 can be used to rapidly feed resilient member 20 into the die cavity. A channel 30 is provided in die wall 15 which forms the die cavity. Channel 30 forms a feed chute which extends from a ball entrance at the top of the die to a position below the fill position for bottom punch 14. After a wire-forming die has been ejected from the die cavity, bottom punch 14 is lowered to a position below the fill position. At this position, resilient member 20 is able to travel through channel 30 and exit on to top surface 17 of bottom punch 14. The angled top surface 17 positions resilient member 20 within depression 18. Bottom punch 14 is then raised to the fill position, thereby blocking the exit of channel 30. This process permits a quick and easy method for positioning resilient member 20 on depression 18.

By use of the present method and apparatus, a wire-drawing die can be formed very quickly and very accurately. The present method and apparatus eliminate the secondary operations of grinding to expose the wire drawing hole and grinding to form a desired contour shape. Furthermore, the use of the resilient member 20 positioned within depression 18 permits a substantial degree of tolerance not ordinarily encountered in such prescision operations. Thus, the production speed for forming the wire-drawing dies greatly out pace those of the prior art.

While I have described certain presently preferred embodiments of my invention, it is to be distinctly understood that the invention is not limited thereto and may be otherwise variously practiced within the scope of the following claims.

I claim:

1. A method for producing powdered metal compacts in a press having a first punch provided with a stem for forming a hole through the compact and a second punch opposing said first punch, said first punch and said second punch forming the perimeters of a die cavity, comprising the steps of:

a. providing a resilient member upon said second punch, said resilient member positioned such that it is opposite said stem of said first punch;

b. introducing powder metal into said die cavity of said press;

c. compacting said powder metal by pressing said first punch and said second punch together causing said stem of said first punch to engage and penetrate said resilient member;

d. releasing said first punch from said second punch to expose said die cavity.

2. The method of claim 1 wherein a depression is provided in said second punch opposite said stem of said first punch and said resilient member is placed within said depression.

3. The method of claim 1 wherein said resilient member is shaped to provide said powder metal compact with a desired configuration.

4. The method of claim 3 wherein said resilient member is a plastic sphere.

5. The method of claim 3 wherein said resilient member is a rubber sphere.

6. The method of claim 3 wherein said resilient member is a nylon sphere.

7. The method of claim 1 wherein a channel is provided in a side wall of said die cavity, said channel extending from an upper entrance on an outside portion of said side wall to a lower exit on an inside portion of said side wall, and the step of providing a resilient member upon said second punch comprising the steps of:

(a) lowering said second punch from a position where it blocks said exit of said channel to a position where it is below said entrance of said channel;

(b) releasing a resilient member into the entrance of said channel so that said resilient member will exit said channel on to said second punch; and (c) raising said second punch to a position at which said second punch blocks said exit of said channel.

* * * * *